US009540201B2

(12) United States Patent
Talvitie

(10) Patent No.: US 9,540,201 B2
(45) Date of Patent: Jan. 10, 2017

(54) METHOD AND APPARATUS FOR ACCELERATING A ROLL TO A TARGET

(71) Applicant: ABB Oy, Helsinki (FI)
(72) Inventor: Tapio Talvitie, Helsinki (FI)
(73) Assignee: ABB Oy, Helsinki (FI)

( * ) Notice: Subject to any disclaimer, the term of this patent is extended or adjusted under 35 U.S.C. 154(b) by 891 days.
(21) Appl. No.: 13/706,373
(22) Filed: Dec. 6, 2012
(65) Prior Publication Data
US 2013/0146701 A1 Jun. 13, 2013
(30) Foreign Application Priority Data
Dec. 7, 2011 (EP) ..... 11192323
(51) Int. Cl.
*B65H 19/18* (2006.01)
(52) U.S. Cl.
CPC ..... *B65H 19/1821* (2013.01); *B65H 2511/212* (2013.01); *B65H 2511/51* (2013.01); *B65H 2513/21* (2013.01)
(58) Field of Classification Search
CPC ..... B65H 19/1821; B65H 19/1868; B65H 2511/212; B65H 2511/51; B65H 2511/512; B65H 2513/104; B65H 2557/33; B65H 2220/02; B65H 2220/01; B65H 2220/03
USPC ... 242/554, 554.1, 554.2, 554.6, 555, 555.3, 242/555.4
See application file for complete search history.

(56) References Cited

U.S. PATENT DOCUMENTS 3,746,272 A * 7/1973 Rotolo ..... B65H 19/181 156/504
4,021,002 A * 5/1977 Meihofer ..... B65H 26/06 242/554
4,077,580 A 3/1978 Lang et al.
4,181,847 A * 1/1980 Buschmann ..... B65H 23/1882 226/111
4,821,973 A * 4/1989 Tafel ..... B65H 19/1821 156/353
5,253,819 A 10/1993 Butler, Jr.
5,797,561 A * 8/1998 Madrzak ..... B65H 19/1836 242/554.6
6,096,150 A * 8/2000 Ohno ..... B65H 19/1821 156/157
6,588,696 B1 7/2003 Riihela et al.
(Continued)

FOREIGN PATENT DOCUMENTS

WO WO 00/40491 A1 7/2000

OTHER PUBLICATIONS

European Search Report issued on Apr. 27, 2012 for European Application No. 11192323.

*Primary Examiner* — William A Rivera
(74) *Attorney, Agent, or Firm* — Taft Stettinius & Hollister LLP

(57) ABSTRACT

Method and apparatus of splicing a paper web, in which a paper web from a new reel is spliced to a paper web from an emptying reel and a position of glue or two sided tape in the surface of the new paper reel is marked. The method includes receiving a command for splicing, determining the splicing time instant, accelerating a rotation of the new paper reel, detecting the glue or tape, controlling, based on the detected glue or tape, the rotation of the new paper reel in such a manner that the rotation speed of the new paper reel and the position of the glue or tape are as required at the splicing time instant, and splicing the paper web at the splicing time instant.

7 Claims, 3 Drawing Sheets

(56) References Cited

U.S. PATENT DOCUMENTS

| | | | | |
|---|---|---|---|---|
| 6,695,027 | B2 * | 2/2004 | Hashimoto | B65H 19/1868<br>156/351 |
| 6,764,040 | B2 * | 7/2004 | Kiyota | B65H 19/1821<br>242/554 |
| 7,201,345 | B2 * | 4/2007 | Werner | B65H 19/1821<br>242/554.2 |
| 7,681,830 | B2 * | 3/2010 | Tsuruta | B65B 9/20<br>242/554.3 |

* cited by examiner

METHOD AND APPARATUS FOR ACCELERATING A ROLL TO A TARGET

RELATED APPLICATION(S)

This application claims priority under 35 U.S.C. §119 to European Patent Application No. 11192323.1 filed in Europe on Dec. 7, 2011, the entire content of which is hereby incorporated by reference in its entirety.

FIELD

The present disclosure relates to controlling roll drives, and for example, to accelerating rolls having an unknown initial position to a preferred speed and position within a predetermined time period.

BACKGROUND INFORMATION

In some machinery relating to paper manufacturing, paper webs of the machine reels can be joined so that the post processing can be applied in a continuous manner. For example, in coating machines that are not part of the paper machine, the machine reels can be unwound through the coating machine one-by-one such that the paper can be spliced at full speed. The splicing of paper web refers to a process in which once a machine reel has become empty, the paper from a new machine reel can be attached to the paper from the previous reel so that the post-processing machine can run in continuous manner.

In splicing, the paper from the new machine reel can be glued or taped to the paper of the previous reel before the material in the previous reel ends. The remaining material length is estimated via rate of change in roll diameter, paper thickness calculation and speed. The new reel of material can be prepared by placing glue or two-sided tape to the surface of the material along the width of the reel. The new reel is accelerated such that the surface speed of the new reel corresponds with the speed of the web from the previous reel. The new reel-roll acceleration is initiated well in advance to be fully ready and stable before the splice takes place and material from previous reel runs out. The foreseen time of splice may have some inaccuracy, which is why sufficient time margin is added at a starting point.

When the new reel has reached the desired speed and position, a separate splicing roll or brush pushes the web from the previous reel to the surface of the new reel. The applied glue or tape attaches the webs together after which the web from the previous reel is cut. This way the post-processing machinery, such as an off-machine coating machine, can run continuously without interruptions.

In a splicing process the amount of material left in the emptied reel can be minimized so that as little as possible material is wasted. The tail of the material in the emptied reel can be problematic because after the web has been cut, the material from the previous reel can keep on unwinding for a few more seconds before stopping. This hanging tail can lead to unwanted breaks in the web when it, or parts of it, ends in the route of the new web. Mechanical brakes can be used for braking the emptied reel to stop it as fast as possible for avoiding the problems relating to the hanging tail.

WO 00/40491 discloses a method in which the amount of material left in the emptied reel can be minimized. The minimization can be carried out by gluing the paper layers together near the bottom of the reel, thus preventing the paper to unwind past this point. Making use of this requires the splicing and cutting to happen very close but still before the glued bottom layers appear, so that the cut and hanging tail can be stopped by the glue before any excess unwinding. The position of the bottom glue is identified to the system by a premark in the edge of the web, for example, a fixed distance before. The premark is done together with the bottom glue, in roll preparation area, before the coater.

In known splicing methods, such as in U.S. Pat. No. 4,077,580, when the diameter of the old reel reaches a certain value, the new reel is accelerated to the required splicing speed. The acceleration is carried out with constant parameters. The start of the acceleration takes place in good time before the actual splicing so that the new reel may rotate for minutes.

When the conditions for splicing are met, i.e., the diameter of the old reel reaches another limit, the angular position of the new reel is unknown or at least not predicted. This means that the splicing instant must be delayed until the new reel reaches a known position and then the required position for starting of the splicing. It may take up to one rotation of the new reel for waiting of the known and the required position, and the splicing can be started only after one more rotation of the new reel. Thus, when the conditions for splicing are met, the new reel is still be rotated one to two rotations, which can equal approximately 10 to 22 meters of paper from the old reel.

One of the disadvantages associated with the above methods is that the methods still leave unnecessary tail on the emptied reel. The tail can be up to the length corresponding the whole circumference of the new reel plus distance from emptied reel paper tangent to the cutting device plus the safety margin.

Further, the new reel is rotated somewhat longer than required, which may affect the adherence of the splice because the glue or tape on the surface of the rotating roll dries quickly.

SUMMARY

A method of splicing a paper web is disclosed, in which a paper web from a new reel is spliced to a paper web from an emptying reel and a position of glue or two sided tape in a surface of the new paper reel is marked, the method comprising receiving a command for splicing, determining the splicing time instant, accelerating a rotation of the new paper reel, detecting the glue or tape, controlling, based on the detected glue or tape, the rotation of the new paper reel in such a manner that a rotation speed of the new paper reel and the position of the glue or tape are as required at the splicing time instant, and splicing the paper web at the splicing time instant.

An apparatus for splicing a paper web is disclosed, in which apparatus a paper web from a new reel is spliced to a paper web from an emptying reel and a position of glue or two sided tape in a surface of the new paper reel is marked, the apparatus comprising a processor coupled to a memory and arranged to: receive a command for splicing; determine a splicing time instant; accelerate a rotation of the new paper reel; detect the glue or tape; control, based on the detected glue or tape, the rotation of the new paper reel in such a manner that a rotation speed of the new paper reel and a position of the glue or tape are as required at the splicing time instant; and splice the paper web at the splicing time instant.

A computer program product is disclosed comprising computer program code, wherein the execution of the program code in a computer arranged for controlling an apparatus for splicing a paper web, in which a paper web from a new reel is spliced to a paper web from an emptying reel and a position of glue or two sided tape in a surface of the new paper reel is marked, causes the computer to: receive a command for splicing; determine a splicing time instant; accelerate a rotation of the new paper reel; detect the glue or tape; control, based on the detected glue or tape, the rotation of the new paper reel in such a manner that a rotation speed of the new paper reel and the position of the glue or tape are as required at the splicing time instant; and splice the paper web at the splicing time instant.

BRIEF DESCRIPTION OF THE DRAWINGS

In the following the disclosure will be described in greater detail by means of exemplary embodiments with reference to the attached drawings, in which.

DETAILED DESCRIPTION

Exemplary embodiments of the disclosure are based on using an indicator indicating the position of the glue for controlling the rotation of the new reel. Based on this information, the machine reel can be accelerated such that the reel can be in a required angular position and can reach required speed for the splicing at a pre-determined time instant. Prior to accelerating, the machine reel is in a stand-still state and in an arbitrary angular position. The position of the glue or the two-sided tape can be marked in the side of the reel and this mark can be used for calculating the acceleration such that the required speed and angular position can be obtained at the end of the acceleration.

The optimized acceleration and control of the position can make it possible to minimize the amount of material left in the emptied reel. This can alleviate issues relating to long hanging tails. Also, the reel is not rotated unnecessarily leaving the glue sticky. As the acceleration of the new machine reel is started at the required instant, more time can be left for the preparation of the reel.

Figure 1:
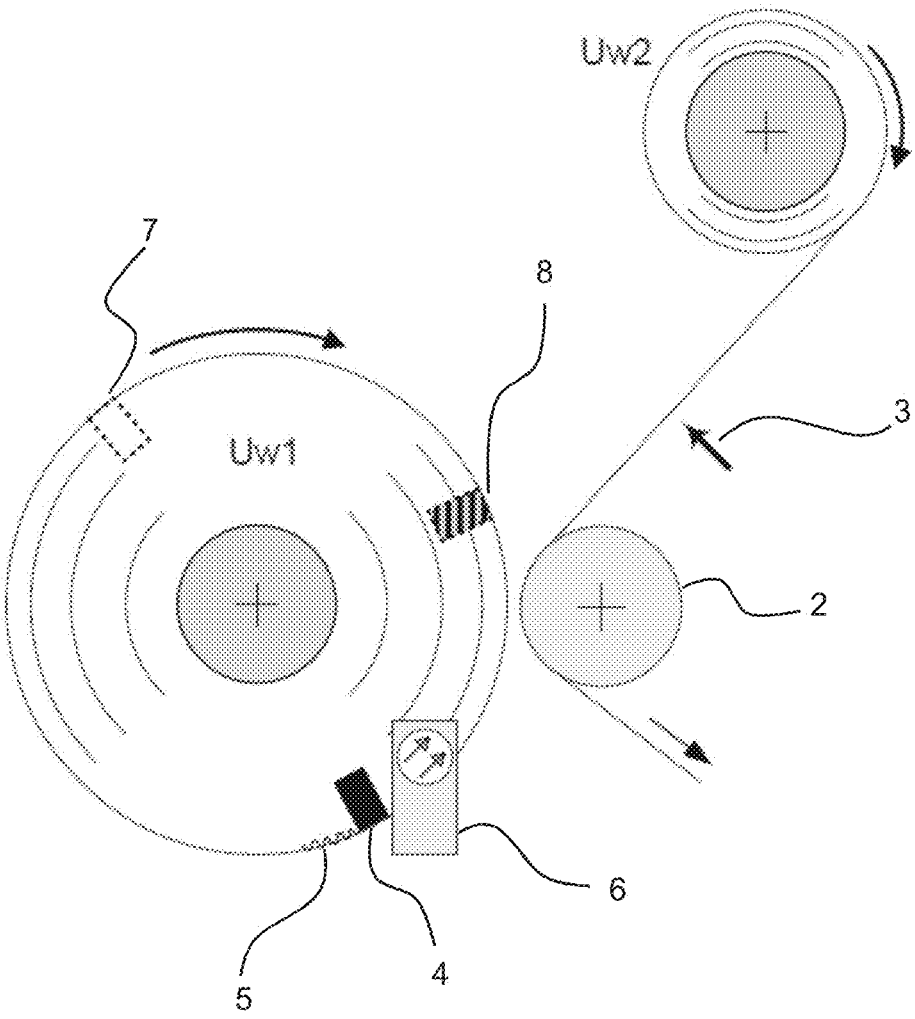
FIG. 1 shows an unwinder station before splicing according to an exemplary embodiment of the disclosure.

FIG. 1 shows an exemplary embodiment of an unwinder station according to the disclosure having an arrangement for splicing the material web. In such a station the material web from a new reel Uw1 can be spliced to material web from old reel Uw2. As seen in FIG. 1, the new reel has a marking 4 showing the position of the applied glue or two-sided tape 5. The glue can be applied at the surface of the new reel in the beginning of the material web. The new reel can be situated in such a way that the marking 4 can be read by a reader 6 which can be positioned stationary in the station. The paper web from the old reel can be fed to a post-processing machine around drum 2. FIG. 1 also shows the cutting knife 3 used for cutting the web at the splicing process.

In a method of an exemplary embodiment of the disclosure, the splicing procedure is started when a command for splicing can be received. This command can be received after receiving an indication of the oncoming bottom glue. This indication can be a premark received by a reader which detects that the material from the old reel is about to end. The end of the material in the reel can be marked for this purpose. When such a mark is read, the amount of material left in the reel can be known. Because the speed of the material web is also known, the remaining time can also be known. Thus, when a marking is detected, the splicing time instant can be determined from the speed of the web and remaining amount of web material. After the detection of the marking, the drive can be also prepared for the acceleration by calculating the used acceleration profile, and after these calculations the command for splicing is received.

After the time instant for the splicing is determined, the new paper reel Uw1 will be started in due time before. Initially the reel is in an unknown angular position, and thus the beginning of the material web together with the applied glue or tape in the reel is in an arbitrary angular position. In the example of FIG. 1, the initial position of the marking 4 is shown with reference numeral 7. Thus, the reel Uw1 has rotated from its initial position.

During the acceleration of the reel Uw1, the marking 4 in the side of the reel is detected with the reader 6. The reader 6 communicates with the control system that sends commands to the motor controlling the rotation of the reel Uw1. In a exemplary embodiment of the disclosure the reel can be accelerated with a known acceleration profile. When the density of the material in the reel, the diameter of the material reel and the inertia of the mechanics is known, the moment of inertia of the entire reel can be calculated in a known manner. The known moment of inertia is fed to the control system and the motor drive driving the reel can be controlled so that the required acceleration profile is obtained. When the acceleration profile is known, the reel Uw1 can be started at the right time instant so that the reel is not rotated unnecessarily long.

In an exemplary embodiment of the disclosure, the time from the start of the acceleration to the time instant when the marking is read for the first time and is measured. Thus, together with the start of the rotation of the reel, a timer can be started. The value of the timer is read when the reader 6 detects the marking 4. The initial position of the marking 4 can be backward calculated once the elapsed time is known together with the known acceleration profile. In an exemplary embodiment, the motor drive rotating the reel Uw1 can be first started with a zero-speed reference. After the zero speed reference has been applied for a short period of time, the reel can be accelerated according to the specified profile. The above mentioned timer can be started once the speed or acceleration reference is released. The zero speed reference can be used so that the drive reacts without delay to the given reference.

Once the position on the new reel glue or tape is detected, the rotation of the reel can be controlled in such a manner that at the determined splicing time instant the speed of the reel and the position of the glue are as required. The required surface speed of the new reel is the speed the web from the old reel is traveling. For the splicing to be successful, the surface speeds of the old reel and the new reel need to be substantially the same. The required position of the glue refers to the position of the glue or the two sided tape in which the splicing can be done. This target position is shown in FIG. 1 with reference numeral 8. Thus the new reel is controlled with the motor drive in such a way, that at the before determined splicing instant, the roll has the required speed and the position of the glue or two-sided tape is located as desired. The desired position refers to the position at which the splicing can be carried out.

Figure 3:
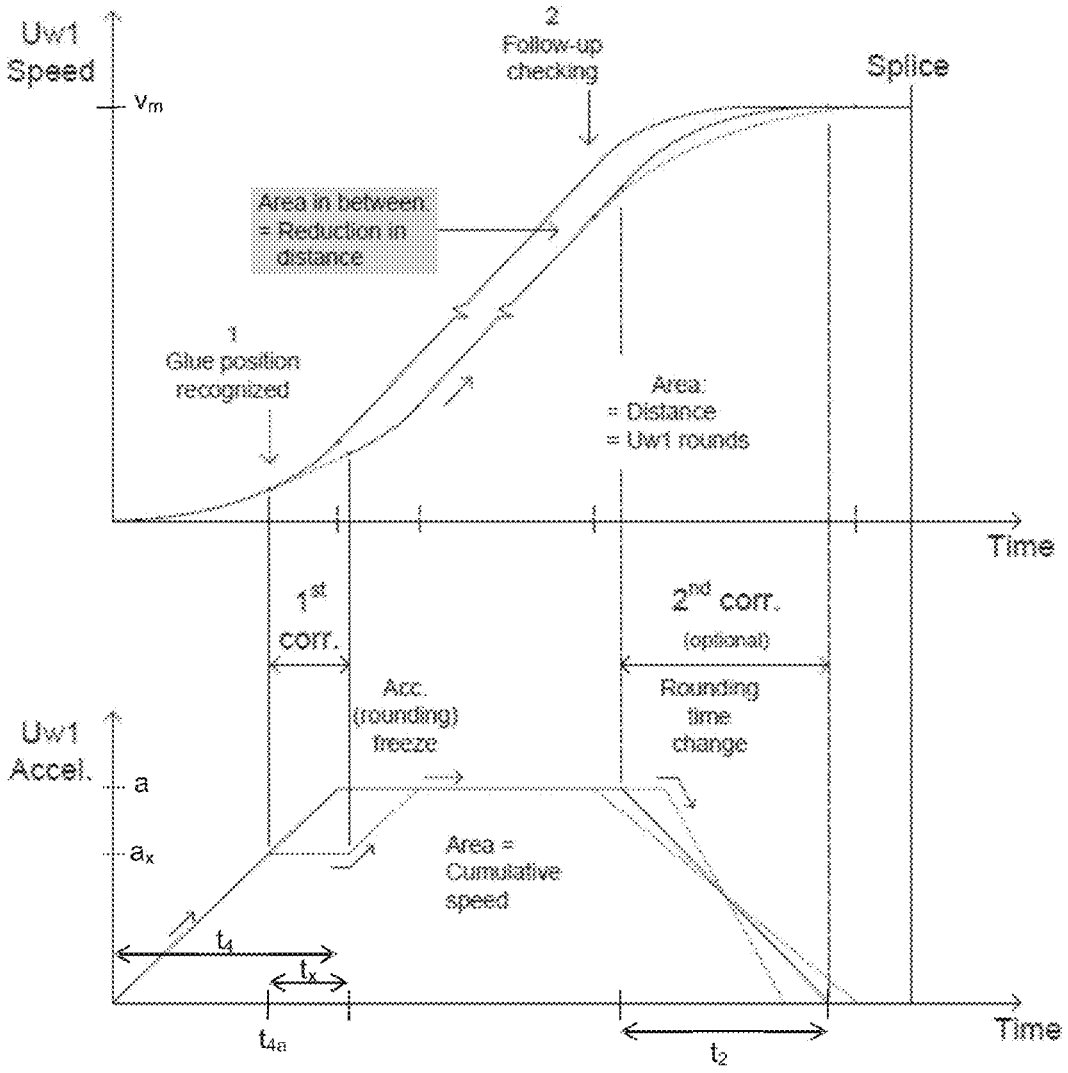
FIG. 3 shows a speed/acceleration profile used during the acceleration before splicing according to an exemplary embodiment of the disclosure.

In an exemplary embodiment according to the disclosure, the reel can be started with a linearly increasing acceleration. The use of increasing acceleration does not necessarily mean that the actual drive receives a reference value for acceleration. The drive, which can contain a frequency converter or similar rotational speed controller, can receive a speed reference producing the required acceleration. FIG. 3 shows an example of the speed and acceleration profile used for controlling the reel Uw1 of an embodiment. The profile can include linearly increasing acceleration, constant acceleration, linearly decreasing acceleration and constant speed run.

When the reel is accelerated with increasing acceleration, the speed of the reel also increases. The speed profile of FIG. 3 shows a rounding in the beginning of the profile when the acceleration increases linearly.

According to an exemplary embodiment, the linearly increasing acceleration can be carried out in such a way that the marking 4 will be detected for the first time during the linearly increasing acceleration. In the example of FIG. 3, the marking is detected at the time instant $t_{4a}$. At the time instant $t_{4a}$ the initial position of the marking can be calculated, and for example, specifically, the required correction to the set profile can be calculated so that the marking 4 will be at the required position at the splicing time instant. The length of travel of the marking 4 on the roll surface during lower rounding of acceleration profile of the reel till first detection can be calculated as $$s_x = \frac{1}{6} a_x t_{4a}^2$$

in which $a_x$ is the current value of acceleration and $t_{4a}$ is the elapsed time since start when the marking is detected. $s_x$ describes the travelled length of the marking 4 back from the reader 6. So the revealed travelled length $s_x$ together with known acceleration profile gives us information to calculate the final position of marking 4 at the time of splicing when no corrections are made at all.

The difference of calculated final position of marking 4 with no corrections and preferred position at the time of splicing is the desired correction in length to be done. The desired correction is $$\Delta s[\mathrm{m}] \tag{1}$$

which depends on the initial position calculated using $s_x$ and the geometry of the system and the final target position which depends on the selected tail length.

The direction of correction is always to backwards, i.e. to shorten the total length Uw1 is turning before splicing. Maximum correction is less than one round of Uw1, i.e. in length less than one circumference of Uw1.

In an exemplary embodiment according to the disclosure, the acceleration can be frozen to the value $a_x$ that it had at the time instant when the marking was detected. Value $a_x$ is less than the final constant acceleration a. Thus when the marking is read at the time instant $t_{4a}$, the increase of acceleration is stopped and the accelerating of the reel can be continued with a constant acceleration. At the same time as the increase of acceleration is stopped, a time period $t_x$ is calculated. $t_x$ is the time period that the acceleration is kept constant, to provide preferred correction in final length, Δs.

The purpose for the change of acceleration is to slow down the acceleration of the reel in such a manner, that the required position of the reel can be met at the splicing time instant. This length is compensated by changing the acceleration/speed profile.

The time period $t_x$, delaying the final acceleration a, as a function of desired correction Δs, can be calculated as $$t_x(\Delta s) = \frac{1}{2}\left[\left(\frac{2v_m}{a_x} - t_4\right) - \sqrt{\left(t_4 - \frac{2v_m}{a_x}\right)^2 - \frac{4\Delta s}{k}}\right] \tag{2}$$

in which $$k = \frac{1}{2} a_x \frac{a - a_x}{a},$$

and a is the constant acceleration of the acceleration profile, $a_x$ is the acceleration at the time instant $t_{4a}$, $v_m$ is the target speed, $t_4$ is the time period of the increasing acceleration in the acceleration profile and Δs is the desired correction as described in (1).

In the speed versus time curve of FIG. 3, the area under the speed curve represents the length of travel. Thus, the difference between the two curves, the one according to the original curve and the curve obtained with the change in acceleration, represents the amount of correction in terms of length of travel. This area should therefore correspond to the value described in term (1).

By default, when time period $t_x$ has elapsed after instant $t_{4a}$, the required correction is done, and the reel acceleration is resumed with a linearly increasing acceleration. The linear increase of the acceleration is the same as in the beginning of the procedure.

When the acceleration reaches a pre-determined value a, the acceleration can be kept constant for a certain time period which is defined by the acceleration profile.

If the moment of inertia of the accelerated reel is correct, the acceleration is continued according to the set profile. This means that after the acceleration with the constant value a, the acceleration is ramped down starting at a certain time instant and using a certain linear decrease of the acceleration. After the acceleration has been ramped down to zero, the reel rotates with a constant speed. This constant speed can be kept for a certain period of time set in the pre-programmed profile. When the period of time with the constant speed is elapsed, the actual splicing can be carried out. When the above procedure is followed, the two-sided tape or glue in the surface of the new reel can be in the correct position and the speed of the surface of the reel corresponds to the speed of the material web at the splicing time instant.

As mentioned above, the true acceleration of the reel may not be ideal. The density of the material set to the control system may not be accurate leading to erroneous moment of inertia of the reel. Further, the control of the drive may contain undetermined delays in communication which might lead to a situation that the control of the drive is not as accurate as required.

The errors in the rotation are taken into account according to an exemplary embodiment of the disclosure. In this embodiment the markings on the reel can be detected during the acceleration. Each time the marking is read, the reel has rotated one revolution and the surface of the reel has travelled a known distance. This advanced distance can be continuously compared with the distance that the acceleration profile provides.

Towards the end of the period in which the acceleration is constant, the difference between the actual travelled length can be compared with the length corresponding to the reference. If these lengths are not equal, then the reel has rotated too much or too little and a recorrection or second correction is useful so that the position of the reel will be correct at the time instant for splicing.

The potential second correction, also called end correction, can be carried out by shortening or lengthening the linear decrease of acceleration, i.e. affecting the sharpness of upper rounding of the speed curve. FIG. 3 shows as a solid line the pre-determined acceleration profile which can achieve the desired position for the reel. FIG. 3 also shows the end corrections in dashed lines in which the change of acceleration is altered from the pre-determined profile. The area under the acceleration curve represents the cumulative speed of the reel. When the pre-determined profile is used, the speed corresponds to the desired speed when the acceleration goes to zero. Thus, when the profile is changed for correcting the position, the area under the acceleration curve should be the same as without the correction. This can be achieved when the profile is changed symmetrically, with a corresponding time difference in the beginning and in the end of the slope. For example, a time value can be calculated by which the decrease of acceleration is changed. The constant acceleration can be changed to decreasing acceleration at the time instant which corresponds to the original time instant to which half of the time value is added. Similarly, the point in which the acceleration reaches zero can be changed by a corresponding time value but in the opposite direction. When the rounding curve of speed is changed, the change can be symmetrical, i.e., shortening or lengthening will affect both sides of the rounding alike, to keep the cumulative speed unchanged. As a result the modified rounding looks either more round or more sharp, and the areas under the speed curve they cover, which are distances, are thus different.

If, for example, the calculation gives time value $t_{corr}$ for the end correction and in the pre-determined profile, the linearly decreasing acceleration is to be started at time instant $t_{s1}$ and ended at time instant $t_{s2}$. Due to the correction $t_{corr}$ the linear ramp is started at time instant $$t_{s1} - \frac{t_{corr}}{2}$$

and correspondingly the end of the ramp is at time instant $$t_{s2} + \frac{t_{corr}}{2}.$$

It should be noted that the sign of the correction $t_{corr}$ depends on the direction of the correction. If the reel rotation is ahead of schedule, then the end rounding, i.e. the linear acceleration ramp can be made longer, and if the reel rotation is behind schedule, then the linear acceleration ramp can be made shorter, which is sharper in form of speed.

During constant acceleration of Uw1 the required first correction in the roll's position is already done, so the roll should now be advancing fully in schedule to reach the desired speed and position in due time. For the potential second correction done in upper rounding, the true advancing of the roll is followed by reading the cumulative markings 4 and comparing that with the set reference curve. The difference of these two gives the value for the second correction. The remaining length in reference we call $s_{REM\text{-}R}$ and remaining length in true advancing of the roll we call $s_{REM\text{-}A}$. The amount in length for the second correction is $\Delta s_2$.

$$\Delta s_2 = s_{REM\text{-}R} - s_{REM\text{-}A}. \tag{3}$$

$\Delta s_2$ receives positive values if the reel has rotated too much with respect to the reference and negative values if the reel has rotated less than expected. When the linear acceleration ramp is shortened, the length of travel of the surface of the reel is prolonged and when the ramp is made longer, the length is made shorter.

The correction $\Delta t$ to the end rounding time $t_2$ as a function of $\Delta s_2$ i.e. to the linear decrease of the acceleration can be calculated as $$\Delta t = \frac{1}{2}\left(-t_2 + \sqrt{t_2^2 + \frac{24\Delta s_2}{a}}\right) \tag{4}$$

when the $\Delta s_2$ is positive, and as $$\Delta t = \frac{1}{2}\left(t_2 - \sqrt{t_2^2 - \frac{24\Delta s_2}{a}}\right) \tag{5}$$

when $\Delta s_2$ is negative.

In the above equations $t_2$ is the duration of the upper rounding of the pre-determined profile and a is the constant acceleration from which value the rounding is started. With positive $\Delta s_2$ the ramp time is prolonged and with negative $\Delta s_2$ the ramp is shortened in above described manner such that the required speed can still be obtained.

When the acceleration has decreased to zero, the speed can be kept constant until the defined splicing time instant. The duration of the constant speed region in the profile depends on the amount of end correction such that the period of constant speed can be either shortened or prolonged from the originally defined profile depending on the possible shortening or prolonging of the linearly degreasing acceleration. The duration of the constant speed region should be selected in such a way, that it allows to lengthen the linear decrease of the acceleration.

Figure 2:
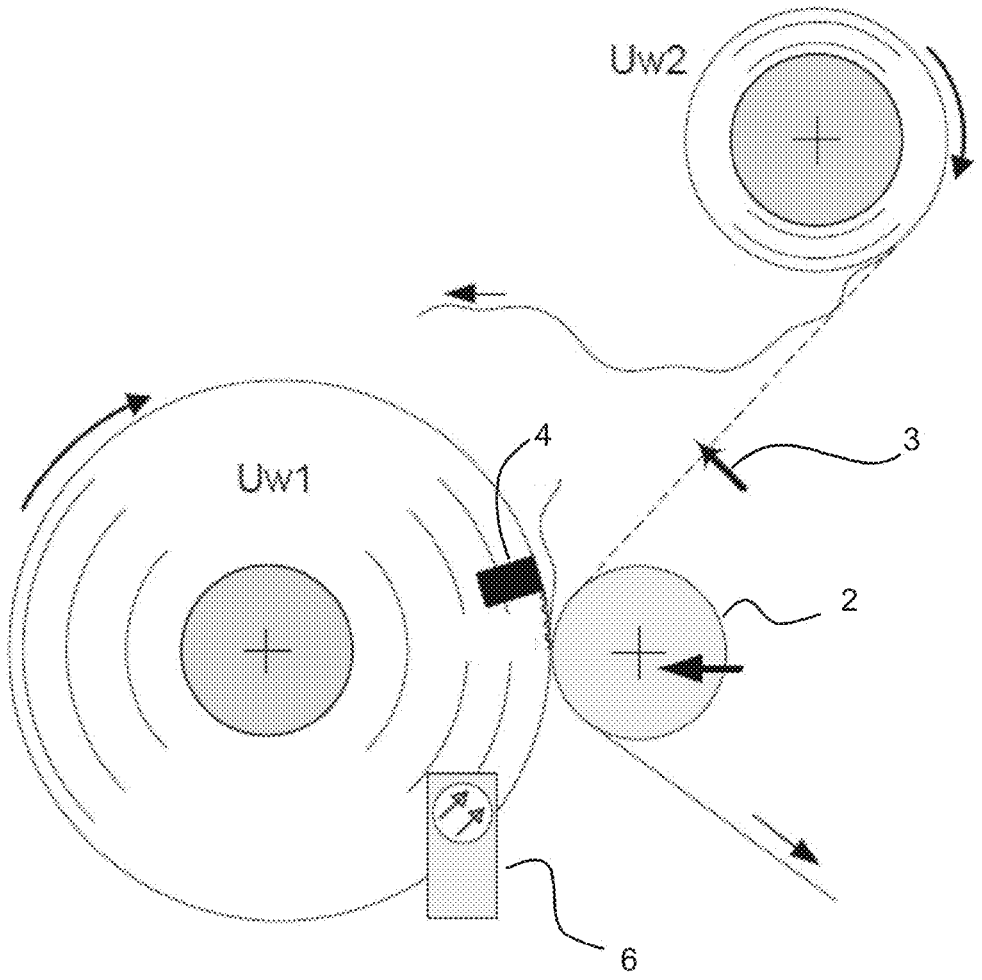
FIG. 2 shows an unwinder station during splicing according to an exemplary embodiment of the disclosure.

According to an exemplary embodiment of the disclosure, the splicing can be carried out at the determined splicing time instant. FIG. 2 shows the splicing of the web. In the splicing process, the nip between the drum 2 and the new reel is closed and the drum 2 pushes the material web unwound from the old reel Uw2 against the surface of the new reel Uw1 in such a manner, that the material web is attached to the glue or two-sided tape in the surface of the new reel. Timewise very near to the above web attaching procedure the web from the old reel is cut with the cutting knife 3. Exact timing of the cut vs. Uw1 position depends on preset splice tail length and geometry of the mechanics, which all are known.

As the material web travelling to the post-processing machine from the old reel Uw2 is cut, the material from the new reel starts to unwind to the post-processing machine. The process in the unwinder station is continued such that when most of the material in reel Uw1 gets unwound, it is lifted to the position of the old reel Uw2. The mechanics of the machine allows to move the reel only when the weight of the reel is below a certain limit. Once the position of the reel is changed, a new reel is placed in the station in the place of the reel Uw1.

In an exemplary embodiment of the present disclosure, the marking 4 in the side of the reel can be used for controlling the rotation of the reel in question in a desired manner. It should also be noted, that the physical marking 4 on the side of the reel, can be replaced by some other arrangement that yields similar output, like a pulse counter in motor encoder, that generates virtual markings 4, to indicate the passing of the tape on reel surface. But the result can be the same.

The acceleration/speed profile used in the exemplary embodiment can be calculated once the properties of the new reel are obtained. As mentioned, the density of the material and dimensions of the reel affect the moment of inertia of the reel. The obtainable acceleration is dependent on the power rating of the motor drive and the moment of inertia of the reel. The increasing acceleration ramp, i.e. the lower rounding should be so long that the marking in the reel is read once during the ramp so that the acceleration can be frozen below final acceleration rate during the ramp. The first correction is very effective and it can do all that is needed to put the new reel in right position. The second correction can be somewhat limited in its capability and can only fine tune the result, e.g. +–0.25 revolutions, unless excess time margins are reserved for its use, meaning long constant acceleration time and long constant speed time.

The above described exemplary embodiment for controlling the speed of the reel in desired manner can easily carry out the changes and the calculations needed to be calculated during the acceleration are minimal.

It is clear to a skilled person, that when an acceleration profile is given, this profile can be changed to a speed profile. Thus the acceleration reference can be changed to a speed reference that can be given to a device controlling the rotation of the reel.

The rotation of the reel can be controlled with a frequency converter which controls a motor connected to the reel. A frequency converter can include a processor and readable memory. The method of the disclosure can be carried out using the processor and the memory and known mechanical parts forming a station for carrying out the splicing procedure. Therefore, when a computer program code is executed in connection with a frequency converter, for example, it can perform the method of the disclosure. For example, a frequency converter can perform the steps of receiving a command for splicing, determining the splicing time instant, accelerating the new paper reel, receiving information of detecting the glue or tape and controlling, based on the detected glue or tape, the rotation of the new paper reel in such a manner that the rotation speed of the new paper reel and the position of the glue or tape are as required at the splicing time instant.

The calculation capacity required for the disclosure can also be situated outside the frequency converter. It can, for example, be possible, that the frequency converter receives only speed or acceleration references from an upper process computer. It can also be possible, that an upper process computer gives frequency converter some other parameters and the frequency converter builds the used acceleration/speed profile according to these parameters and starts the procedure.

It will be obvious to a person skilled in the art that, as the technology advances, the inventive concept can be implemented in various ways.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A method of splicing a paper web, in which a paper web from a new reel is spliced to a paper web from an emptying reel and a position of glue or two sided tape in a surface of the new paper reel is marked, the method comprising:

receiving a command for splicing;

determining a splicing time instant;

accelerating a rotation of the new paper reel;

detecting the glue or tape;

controlling, based on the detected glue or tape, the rotation of the new paper reel in such a manner that a rotation speed of the new paper reel is such that a surface speed of the new paper reel corresponds to a travel speed of the paper web and the position of the glue or tape is such that the splicing is done at the splicing time instant; and splicing the paper web at the splicing time instant.

2. The method according to claim 1, wherein the accelerating of the rotation of the new paper reel comprises:

accelerating the new paper reel using a pre-defined acceleration profile, which comprises linearly increasing acceleration, constant acceleration and linearly decreasing acceleration.

3. The method according to claim 2, comprising:

detecting the glue or tape for the first time during the linearly increasing acceleration, and after the detection, calculating a correction period (tx);

leaving the acceleration to the value at the time instant of the detection for the correction period (tx); and after the correction period, accelerating the new paper reel with linearly increasing acceleration until a pre-defined acceleration (a) is reached.

4. The method according to claim 3, comprising after the pre-defined acceleration (a) is reached:

accelerating the new paper reel with the constant acceleration (a); and accelerating the new paper reel with linearly decreasing acceleration until the acceleration ramps to zero.

5. The method according to claim 4, comprising:

detecting the glue or two-sided tape during each rotation of the new paper reel;

calculating an actual distance the surface of the new paper reel has travelled during the acceleration;

calculating a distance the surface of the new paper reel should have travelled according to the pre-defined acceleration profile;

calculating an error between the calculated distances; and changing a time instant of a start of the linearly decreasing acceleration and a slope of the linearly decreasing acceleration on the basis of the calculated error in distances.

6. The method according to claim 5, wherein the changing the time instant of the start of the linearly decreasing acceleration comprises:

changing the linearly decreasing acceleration in such a way that speed gained during the decreasing acceleration is the same as with a pre-defined slope of the decreasing acceleration.

7. The method according to claim 1, wherein after the linearly decreasing acceleration the method comprises:

rotating the new paper reel with a constant speed until the splicing time instant.

* * * * *